United States Patent [19]

Franz

[11] 4,448,573

[45] May 15, 1984

[54] SINGLE-STAGE, MULTIPLE OUTLET CENTRIFUGAL BLOWER

[75] Inventor: Joseph P. Franz, Erie, Pa.

[73] Assignee: General Electric Company, Erie, Pa.

[21] Appl. No.: 361,958

[22] Filed: Mar. 25, 1982

[51] Int. Cl.[3] ..... F04D 29/40

[52] U.S. Cl. ..... 415/206; 415/219 B; 415/219 C

[58] Field of Search ..... 415/93, 101, 144, 203, 415/204, 206, 219 C, 207, 219 B, 182

[56] References Cited

U.S. PATENT DOCUMENTS

| | | | |
|---|---|---|---|
| 1,675,199 | 6/1928 | Smith . | |
| 1,675,200 | 6/1928 | Smith . | |
| 2,190,670 | 2/1940 | Mann . | |
| 3,019,963 | 2/1962 | Eck | 415/204 |
| 4,349,311 | 9/1982 | Milz | 415/206 X |

FOREIGN PATENT DOCUMENTS

| | | | |
|---|---|---|---|
| 190803 | 8/1956 | Norway | 415/207 |
| 132105 | 3/1929 | Switzerland | 415/144 |
| 139906 | 3/1930 | Switzerland | 415/144 |
| 650815 | 3/1951 | United Kingdom | 415/144 |

OTHER PUBLICATIONS

F. A. Kristal and F. A. Annett: Pumps, pp. 53–59 and 92 (McGraw-Hill Book Co., N.Y., 1940).

*Primary Examiner*—Stephen Marcus
*Assistant Examiner*—Joseph M. Pitko
*Attorney, Agent, or Firm*—Albert S. Richardson, Jr.

[57] ABSTRACT

The rotatable impeller of a single-stage centrifugal blower is housed in a casing one side of which comprises a spiral plenum having an opening which extends along a predetermined limited portion of the perimeter of the impeller and the other side of which includes a port located near the periphery of the impeller but displaced from the opening of the plenum so that it is out of register with that opening. The spiral plenum includes an exit section that provides a first fluid outlet from the casing, and the port serves as a second, independent fluid outlet.

7 Claims, 8 Drawing Figures

14
24
29
28
13
47
41
14a
42
31
24
44
36
33
34
11
32
33
17
39
16
35
19
23
22
21
12
17

SINGLE-STAGE, MULTIPLE OUTLET CENTRIFUGAL BLOWER

BACKGROUND OF THE INVENTION

This invention relates generally to centrifugal blowers or fans, and it relates more particularly to the structure of the housing of a single-stage, multiple outlet centrifugal blower.

Centrifugal blowers, ventilators, fans, pumps, and other similar apparatus are conventionally designed and constructed to raise the pressure of an incompressible fluid and to discharge the fluid at a desired volume rate of flow into a pipe or duct to which the outlet of the apparatus is connected. The fluid, in order to move continuously through the discharge duct of the connected system, has to be supplied with enough energy to overcome the downstream backpressure at the outlet of the apparatus. This backpressure is the sum of the pressure drop in the downstream system caused by the fluid resistance of the discharge ducts and the total fluid pressure (velocity pressure plus static pressure) at the exit end of the ducts.

It is relatively easy to design or to select a centrifugal pump, blower, or the like capable of discharging fluid through a single outlet at a pressure and volume flow that match the requirements of any system having only one discharge path and one exit. However, this is not true if the downstream system has two or more separate branches which are required to deliver different volume flows at various different pressures. A practical example of the latter system is found in electric drives on large, self-propelled, off-highway traction vehicles where a prime mover-driven blower supplies air for cooling both an electric current generator (or alternator) and a plurality of traction motors associated with the wheels of the vehicle. The volume flow rate of air required to cool the motors can be appreciably higher than the volume flow rate of air that cools the generator, and the backpressure of the air that cools the motors can vary from one size vehicle to another. When a prior art single-outlet blower is used, the ductwork between the blower outlet and the generator has heretofore included an artificial restriction that provides relatively high resistance to the flow of air in this branch of the system, thereby reducing the volume flow rate of cooling air that flows to the generator compared to the volume flow of air in the other branch of the ductwork that is connected between the same outlet and the traction motors. Such a restriction results in an undesirable loss of power, and it reduces the efficiency of the system.

SUMMARY OF THE INVENTION

Accordingly, the objective of the present invention is to provide an improved single-stage centrifugal blower capable of efficiently suppling fluid, such as air, to a multi-branch discharge system requiring different flow rates in its respective branches and not having an untoward loss of power in any branch.

In carrying out the invention in one form, a casing for the rotatable impeller of a single-stage centrifugal blower is defined by a generally planar barrier on the intake side of the impeller, a generally spiral plenum on the other side of the impeller, and means for joining the plenum to the perimeter of the barrier. The barrier has a first port in its central region that provides an inlet for air entering the eye of the impeller. The blades of the rotating impeller move the air from axial to peripheral regions of the impeller and through an opening into the spiral plenum which has an exit section that provides a first outlet from the casing. The opening into the plenum extends along a predetermined limited portion of the periphery of the impeller. The aforesaid barrier has a second port in a generally arcuate region that embraces another portion of the periphery of the impeller. Consequently the second port is out of register with the opening between the periphery of the impeller and the spiral plenum, and it provides a second outlet from the casing. The pressure and volume flow rate of air discharging through the second outlet is dependent on the shape and cross-sectional area of the second port and on the fluid backpressure on the discharge side of this port, and it is substantially independent of the pressure and volume flow rate of air discharging through the first outlet, whereby changes or variations in the backpressure at either one of the outlets will not significantly affect the flow of air that is discharged from the other outlet.

The invention will be better understood and its various objects and advantages will be more fully appreciated from the following description taken in conjunction with the accompanying drawings.

BRIEF-DESCRIPTION OF THE DRAWINGS

DESCRIPTION OF THE PREFERRED EMBODIMENT

Figures 1, 2, 3, 5:
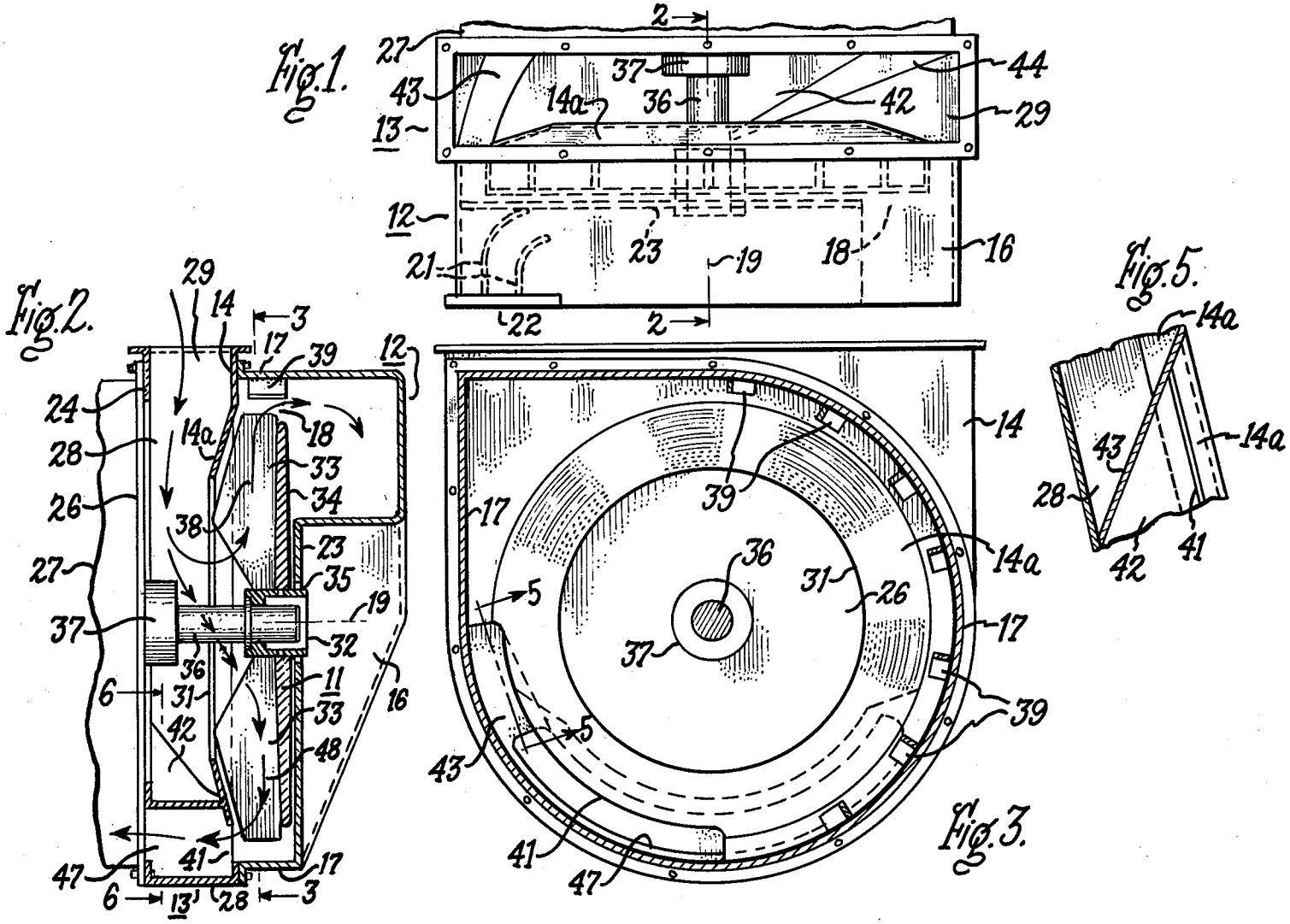
FIG. 1 is a plan view of a single-stage multiple outlet centrifugal blower embodying the present invention.
FIG. 2 is a cross-sectional view of the blower, through the axial centerline 2—2 of FIG. 1.
FIG. 3 is a transverse cross-sectional view of the blower through line 3—3 of FIG. 2, with the impeller omitted.
FIG. 5 is a sectional view taken on line 5—5 of FIG. 3.
Figure 8:
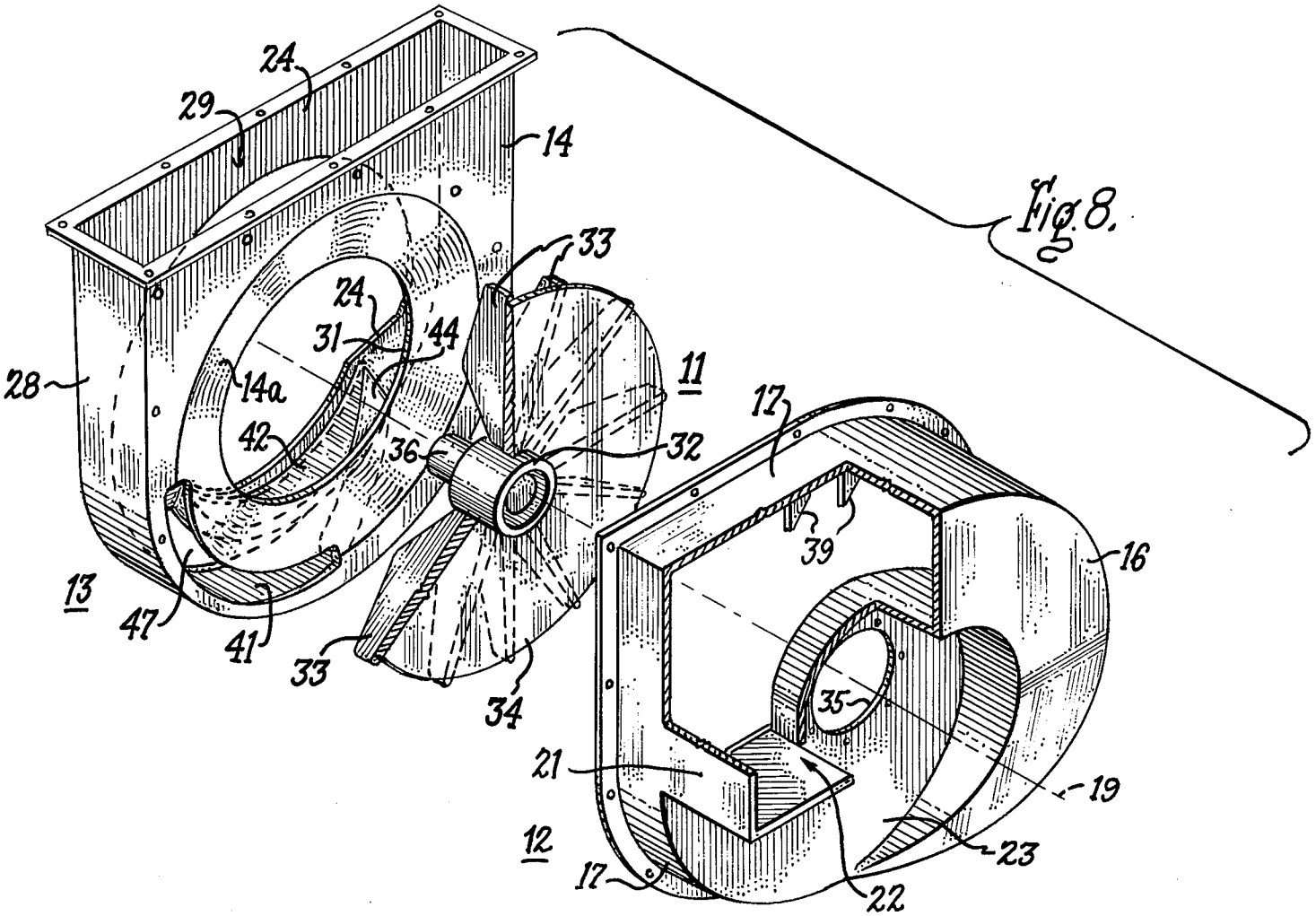
FIG. 8 is an exploded isometric view of the basic parts of the blower.

Referring now to the drawings, and particularly to FIGS. 1, 2 and 8, there is shown a single-stage, multiple outlet centrifugal blower comprising a rotatable impeller 11 inside a housing which is formed by juxtaposed casings 12 and 13. The first casing 12 encloses the impeller 11. The additional casing 13, which is mounted alongside of the first casing 12 and is separated therefrom by a generally planar barrier 14, serves as an inlet chamber for the fluid (hereinafter assumed to be air) that is supplied to the blower.

Figure 4:
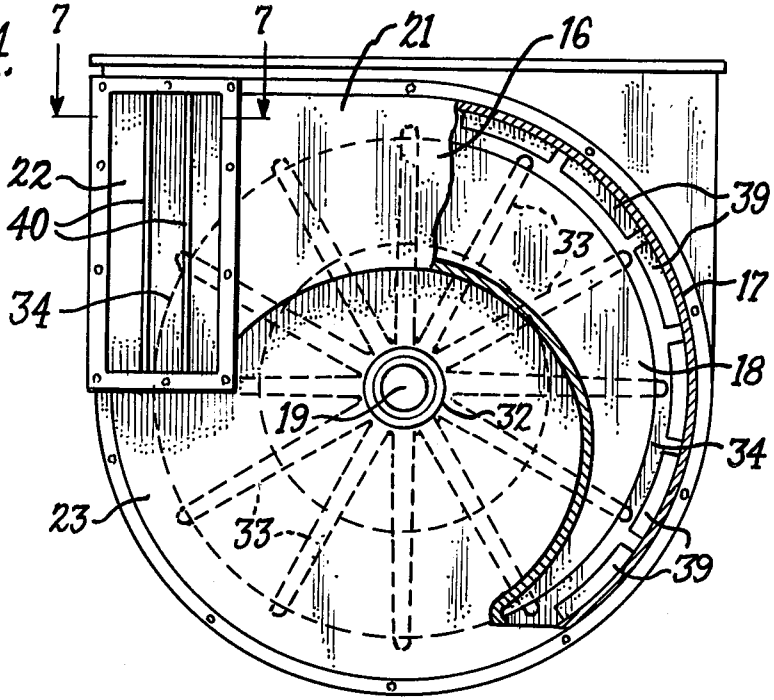
FIG. 4 is an elevational view, partly broken away of the spiral plenum side of the impeller casing of the blower shown in FIG. 1.

As can be seen in FIGS. 2, 4, and 8, one side of the impeller casing 12 comprises a generally spiral or involute plenum or scroll 16 which is joined to the perimeter of the barrier 14 by means of a curvilinear wall 17. The inboard side of this plenum has a progressively expanding opening 18 that begins at the bottom of the blower and extends in a counter-clockwise direction (as viewed in FIGS. 4 and 8) along a predetermined limited portion of the periphery of the impeller. In the preferred embodiment of the invention, the opening 18 extends through an arc of approximately 270 degrees in a plane perpendicular to the axis 19 of the impeller 11. It is widest in the upper left quadrant of the illustrated blower where it communicates with the exit section 21 of the spiral plenum 16. The exit section or throat 21 includes a flanged aperture that provides a first outlet 22 for the discharge of air from the casing 12. In the illustrated embodiment the aperture 22 has a rectangular shape, and it faces in an axial direction. However, as will be apparent to a person skilled in the art, the configuration of the plenum's exit section 21 is not critical, and it can deviate from what is shown in the present drawings to appropriately accomodate the particular shape, size, and direction of a downstream duct or airway (not shown) that will be connected to the blower at the fluid outlet 22.

The outboard side of the lower left quadrant of the impeller casing 12 (as viewed in FIGS. 4 and 8) is closed by a sidewall comprising a flat plate 23. The various parts of the casing 12 (i.e., the barrier 14, the plenum 16, the wall 17, and the plate 23) can be either fabricated from sheets of metal (e.g., steel) or molded from suitable insulating material (e.g., fiberglass). As is shown in FIGS. 2,3, and 4, the curvilinear wall 17 has a flange that is bolted to the perimeter of the barrier 14.

In the illustrated embodiment of the invention, the barrier 14 is also a sidewall of the air inlet casing or chamber 13. The opposite sidewall 24 of the casing 13 is in turn bolted to a flange of the framehead 26 of a cylindrical electrodynamic machine 27 which is partially shown in FIGS. 1 and 2. The perimeters of the respective sidewalls 14 and 24 are joined to one another by a curvilinear wall 28 except at the top of the casing 13 where a flanged opening admits air into an entrance section 29 of the inlet chamber. The entrance section 29 is in communication with a large circular port 31 which is located in a central region of the barrier 14. The port 31 provides a fluid inlet to the adjoining casing 12 in the vicinity of the eye of the impeller 11.

The impeller 11, which is enclosed in the casing 12 of the illustrated blower, preferrably comprises a hub 32, a plurality of tapered, flat blades 33 extending radially from the hub 32, and an impervious, circular backplate or shroud 34 integrally attached to the straight edges of the blades 33 on the side of the impeller adjacent to the spiral plenum 16. Instead of the illustrated paddle type blades, the impeller blades 33 could be either forward or backward curved if desired. The impeller hub 32 is suitable mounted on a rotating shaft 36 which protrudes from the adjoining end of the machine 27 where it is supported by a large bearing 37 in the framehead 26. The shaft 36 is an extension of a rotor inside the machine 27 which, in one practical application of the invention, is an electric current alternator driven by a diesel engine (not shown) at a speed in the range from 1,800 to 2,100 revolutions per minute. As shown in FIGS. 1 and 2, the impeller shaft 36 traverses the air inlet chamber 13 and extends through the middle of the port 31 in the barrier 14. The hub 32 of the impeller is mounted on the distal end of shaft 36, and it protrudes through a hole 35 in the flat sidewall 23 of the casing 12. The annular gap between the hub 32 and the edge of the hole 35 is sealed by a suitable cover (not shown).

The barrier 14 is disposed on the intake side of the blades of the impeller 11, and, as is indicated in FIGS. 1, 2, and 8, it has a conical section **14*a* to accomodate the tapered edges of the paddle blades 33. The curvilinear wall 17 of the impeller casing 12 is spaced from the circumference of the impeller to enable air inside the casing 12 to flow from the periphery of the impeller blades 33 into the spiral plenum 16. To reach the plenum 16, the air must flow through the gap between the wall 17 and the perimeter of the impeller backplate 34 which has a radius less than the radius of the tips of the blades 33**. In one practical embodiment of the invention the blade tip radius is 17 inches.

In FIG. 2 the arrowed lines 38 depict the flow of air through the blower in a generally axial direction from the central fluid inlet of the impeller casing 12, in an outward radial direction through the interblade spaces, and again in an axial direction into the opening 18 of the spiral plenum 16. To help guide the air from the impeller periphery into the opening of the plenum, a plurality of parallel, inwardly extending, stationary vanes 39 are attached to the inside of the wall 17 at spaced-apart intervals. Each of these vanes 39 is disposed at an appropriately oblique angle with respect to the impeller axis 19, and it serves the dual functions of turning the air into the plenum 16 and reducing the velocity of the air.

Figure 7:
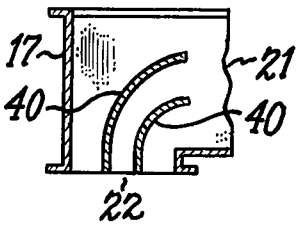
FIG. 7 is a sectional view taken on line 7—7 of FIG. 4.

The blower as hereinbefore described operates in a conventional manner. The impeller, which rotates in a counter-clockwise direction (as viewed in FIG. 4), throws air centrifugally from its axial region through the interblade spaces to the periphery or tips of the blades. In the process the air is accelerated to a high velocity having both tangential and radial components, and air pressure increases substantially as a result of the high centrifugal force. As the air impinges on the guide vanes 39, passes through the opening 18, and flows through the spiral plenum 16 to the first fluid outlet 22, its velocity is gradually reduced, whereby some of the high velocity-pressure head of the air is converted into a desired static-pressure head. The pressure and volume flow rate of the air discharging from the casing 12 through the outlet 22 depends on the design of the spiral plenum 16, including the configuration of its exit section 21, and on the fluid backpressure in the downstream airway (not shown) on the discharge side of the outlet 22. If desired, additional guide vanes or baffles 40 can be installed in the exit section 21 of the spiral plenum 16, as is show in FIGS. 4 and 7.

In accordance with the present invention, the impeller casing 12 includes a second, independent fluid outlet comprising a second part 41 in a generally arcuate region of the barrier 14 near the periphery of the impeller 11. Preferrably the port 41 is a curved slot extending over an arc of approximately 90 degrees in a plane perpendicular to the impeller axis 19. As shown in FIGS. 3 and 8, the arcuate region of barrier 14 where the port 41 is located is disposed in the lower left quadrant of the blower, whereby it is displaced from the opening 18 of the spiral plenum 16 on the opposite side of the casing 12. In other words, the opening 18 into the plenum is out of register with the fluid outlet 41.

By thus distributing the two independent outlets of the casing 12 around the circumference of the impeller blades 33, each blade tip sweeps past the port 41 and the opening 18 in sequence during each revolution of the impeller 11, and the air that discharges during one complete revolution from each interblade space enters either the plenum 16 (during approximately three-quarters of a period of one revolution) or the port 41 (during the remaining one-quarter of the period). The pressure and volume flow rate of the air leaving the casing 12 through the second fluid outlet are depending on the shape and cross-sectional area of the second port 41 and on the fluid backpressure on the discharge side of this port, and they are substantially independent of the pressure and volume flow rate of air discharging through the first outlet 22. Consequently, neither the amount of backpressure of the air discharged from the first outlet nor variations in the air flow resistance of the downstream discharge ducts connected to the first outlet will significantly affect the flow of air discharging from the second outlet, and vice versa.

Figure 6:
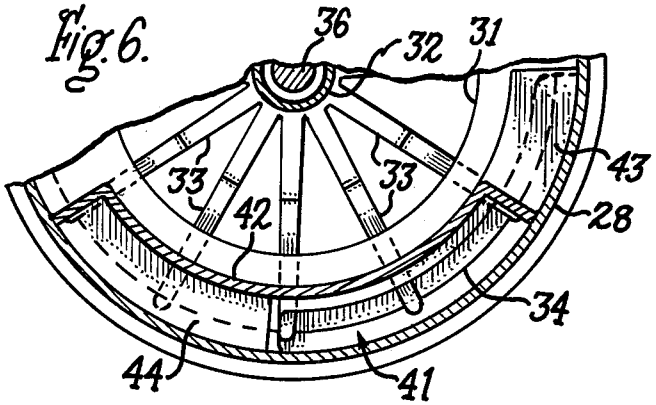
FIG. 6 is a sectional view taken on line 6—6 of FIG. 2.

In the illustrated embodiment of the invention, air discharging from the second outlet 41 of the casing 12 is confined to an airway comprising a duct 42 that communicates with the port 41 and traverses the air inlet chamber 13. As is best seen in FIGS. 1, 6, and 8, the air discharge duct 42 has a generally helical configuration, with its sidewalls 43 and 44 being disposed at oblique angles with respect to the impeller axis so as to provide a more or less streamlined channel for air that discharges from the impeller casing 12 through the port 41. At the exit end of the duct 42 there is an arcuately shaped aperture 47 that communicates with a corresponding opening in the framehead 26 of the machine 27. In FIG. 2 the arrowed lines 48 depict the flow of air through the blower in a generally axial direction from the central fluid inlet of the impeller casing 12, in an outward radial direction through the interblade spaces, and in a reverse axial direction through the second fluid outlet 41, through the helical duct 42, and into the adjoining end of the machine 27.

As was explained above, there are several different factors affecting the division of air between the two discrete discharge paths of the blower, including the size of the opening 18 of the spiral plenum 16 relative to the size of the port 41 that communicates with the helical duct 42. Preferably the port 41 is the complement of the opening 18. That is, if the port 41 extends over an arc of n degrees, the opening 18 extends arcuately for approximately 360-n degrees. In the illustrated embodiment, n is 90 degrees.

In a preferred embodiment of the invention, nearly 3,000 cubic feet of air per minute discharges from the second outlet 41 with the impeller rotating at 1,900 rpm, whereas the volume flow of air discharging from the first outlet 22 can be from approximately one and one-half to more than twice as much.

While one embodiment of the invention has been shown and described by way of example, many modifications will undoubtedly occur to persons skilled in the art. For example, more than two independent fluid outlets can be provided in the impeller casing, with all of them being located respectively in different portions of the periphery of the impeller. The concluding claims are therefore intended to cover all such modifications as fall within the true spirit and scope of the invention.

I claim:

1. A housing for a single-stage, multiple outlet centrifugal blower, comprising:

a. a relatively stationary casing adapted to enclose a rotatable impeller, said casing having a generally planar barrier on the intake side of the impeller, a generally spiral plenum on the other side of the impeller, and means including a curvilinear wall for joining said plenum to the perimeter of said barrier;

b. said barrier having a first port in a central region thereof to provide a fluid inlet in the vicinity of the eye of the impeller;

c. said plenum having an exit section that provides a first fluid outlet from said casing and having an opening in its inboard side that extends along a predetermined limited portion of the periphery of the impeller; and d. a second fluid outlet comprising a second port in said barrier, said second port being located in a generally arcuate region of said barrier near the periphery of said impeller but displaced from said predetermined limited portion of the periphery so that said second port is out of register with said opening of said spiral plenum, the pressure and volume flow rate of fluid discharging through said second outlet being dependent on the shape and cross-sectional area of said second port and on the fluid backpressure on the discharge side of said second port and being substantially independent of the pressure and volume flow rate of fluid discharging through said first outlet, whereby the downstream backpressure of the fluid discharged from either one of said outlets will not significantly affect the flow of fluid discharging from the other outlet.

2. A housing according to claim 1, further comprising a plurality of parallel, spaced-apart vanes extending inwardly from said curvilinear wall in the space between said wall and the circumference of said impeller, each vane being disposed at an oblique angle with respect to the impeller axis so as to guide fluid from the periphery of said impeller into said opening of said spiral plenum.

3. The housing of claim 1 in which said second port is a curved slot extending over an arc of n degrees, and in which said opening of said spiral plenum extends arcuately for approximately 360-n degrees in a plane perpendicular to the axis of the impeller.

4. The housing of claim 1 or 3 in which said second port is a curved slot extending over an arc of approximately 90 degrees.

5. A centrifugal blower comprising the housing of claim 1 and further comprising a rotatable impeller disposed in said casing, said impeller having a plurality of radially extending blades and a circular backplate attached to the edges of said blades on the side of the impeller that is adjacent to said spiral plenum, the radius of said backplate being less than the radius of of the tips of said blades.

6. A housing according to claim 1, further comprising an additional casing mounted alongside of said first-mentioned casing and separated therefrom by said barrier, said additional casing having an entrance section in communication with said first port and a fluid discharge duct that traverses the additional casing and communicates with said second port.

7. The housing of claim 6 in which said fluid discharge duct has a generally helical configuration.

* * * * *